United States Patent [19]

Marocco

[11] Patent Number: 4,945,970

[45] Date of Patent: Aug. 7, 1990

[54] CORD LOCK UNIT FOR DRAPE OR BLIND ASSEMBLY

[76] Inventor: Norbert Marocco, 46 Pennygrass Court, Woodbridge, Ontario, Canada

[21] Appl. No.: 372,564

[22] Filed: Jun. 28, 1989

[51] Int. Cl.[5] ..... E06B 9/38

[52] U.S. Cl. ..... 160/178.2

[58] Field of Search ..... 160/178.2, 178.1

[56] References Cited

U.S. PATENT DOCUMENTS

| | | | |
|---|---|---|---|
| 2,449,583 | 9/1948 | Burns | 160/173 |
| 2,480,993 | 9/1949 | Adler | 160/173 |
| 2,529,229 | 11/1950 | Sherwood | 160/168 |
| 2,587,752 | 3/1952 | Nelson | 160/173 |
| 2,731,111 | 1/1956 | Lorentzen | 188/64 |
| 2,781,091 | 2/1957 | Loucony | 160/173 |
| 2,781,836 | 2/1957 | Bennett | 160/173 |
| 2,786,551 | 3/1957 | Bennett | 188/64 |
| 3,221,802 | 12/1965 | Hurkmans | 160/173 |
| 4,487,243 | 12/1984 | Debs | 160/168 |
| 4,531,563 | 7/1985 | Nilsson | 160/168 |
| 4,667,723 | 5/1987 | Spangenberg | 160/178.2 |

*Primary Examiner*—Blair M. Johnson

[57] ABSTRACT

A cord lock unit is provided for use in a drape assembly having vertically movable drapes or in a horizontal blind assembly having a plurality of horizontal blind slats suspended from a header unit for vertical movement. Such assemblies comprise a pair of spaced apart pull cords for moving such drapes or blind slats vertically. The cord lock unit is designed so that it can be inserted into an opening in a header unit of such an assembly. Such a cord lock unit comprises a first portion larger than the opening in the header rail and a second portion secured to the first portion and dimensioned so as to be insertable through such opening. The unit also comprises resilient engagement means adapted to be deflected during insertion of the second portion to permit such insertion and resiliently to return to a position after such insertion so as then to retain the cord lock unit in position within the opening.

18 Claims, 3 Drawing Sheets

FIG. 1
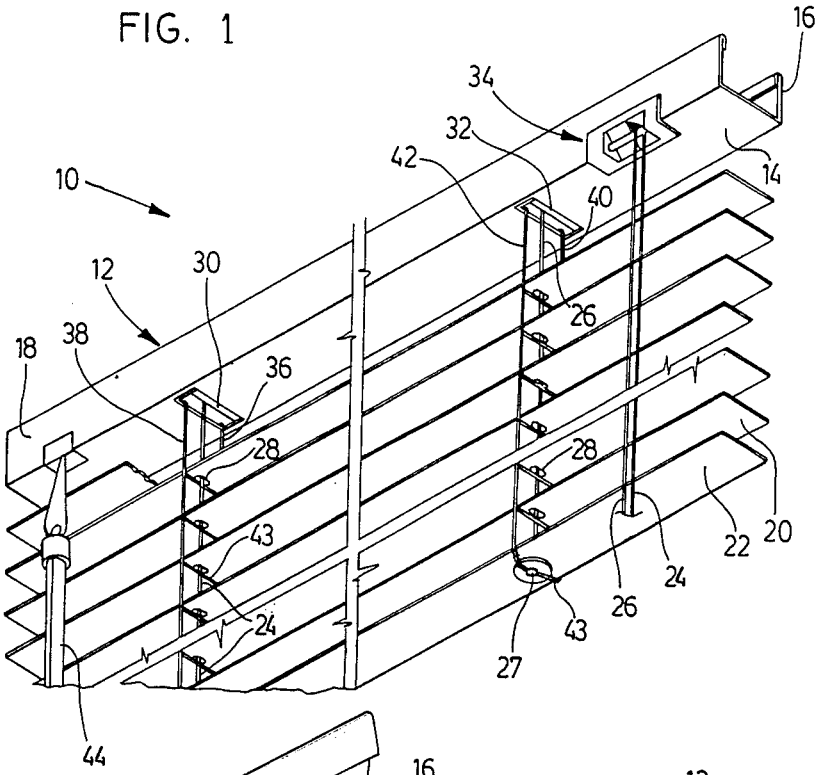
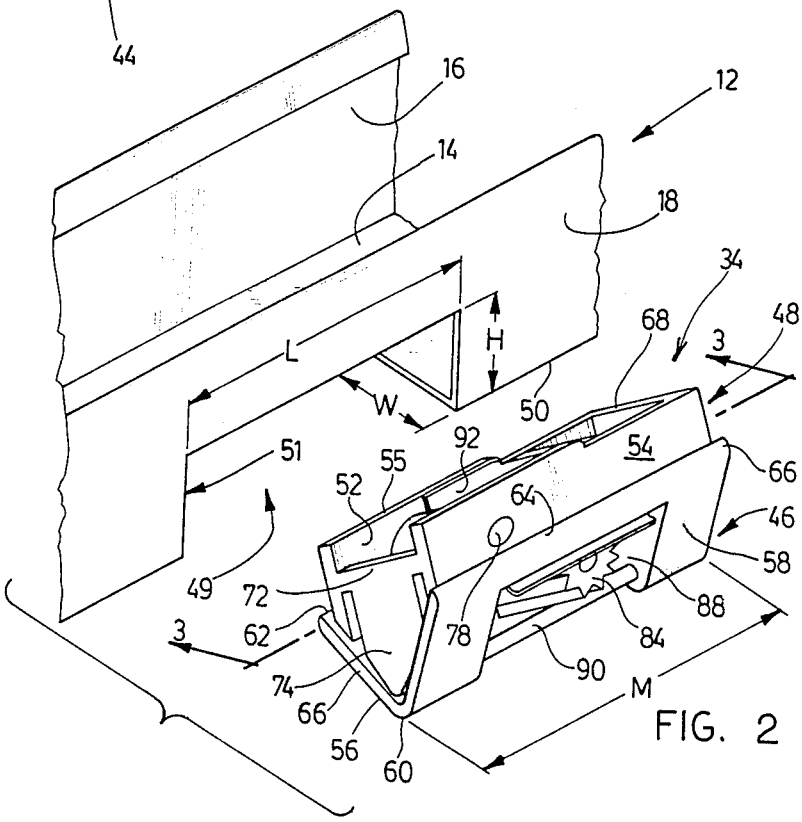
FIG. 2

CORD LOCK UNIT FOR DRAPE OR BLIND ASSEMBLY

FIELD OF THE INVENTION

The present invention relates to window covering assemblies and to cord lock units for use in such assemblies.

BACKGROUND OF THE INVENTION

Existing window coverings such as horizontal blind assemblies, commonly known as Venetian blinds, comprise a header means or channel with a plurality of blind slats suspended therefrom. Spaced apart pull cords extend downwardly from the header channel through openings in the blind slats and are secured to the lowermost slat. Such cords can then be use for raising and lowering the slats.

Additionally, such blind assemblies are generally provided with slat-rotating cords by means of which the slats can be rotated about longitudinal axes between closed and open positions.

Certain forms of window coverings assemblies such as vertically moveable drapes are similarly provided with spaced apart pull cords for raising and lowering.

The pull cords for raising and lowering such window coverings generally pass through the header channel and then hang from one end of that channel as a control loop so that a user can adjust the vertical position of the drapes, slats or the like. Within the header channel, such cords normally pass through a cord lock unit for releasably clamping the pull cords so in turn to hold the blind slats or drapes in any desired horizontal position and to prevent them falling under the effect of gravity to their lowermost position.

Such a cord lock unit is normally provided in the header channel at the position at which the control loop exits that channel. The mechanism provided in such a cord lock unit for releasably clamping the pull cords generally operates in a manner determined by the angular position of the pull cord control loop relative to the header channel. For example, by pulling the control loop in one direction and then allowing the pull cords to raise slightly as a result of the drapes or blind slats falling under the effect of gravity, some form of clamping roller or other mechanism is caused to move into a cord-clamping position. On the other hand, if the control loop is pulled a short distance in a different angular direction relative to the header channel, such a clamping roller or other mechanism is released and moves into a position in which it no longer engages the pull cords.

Various cord lock units and blind assemblies incorporating such units are described in U.S. Pat. Nos. 2,449,583, 2,480,993, 2,529,229, 2,587,752, 2,731,111, 2,781,091, 2,781,836, 2,786,551, 3,221,802 and 4,487,243.

In manufacturing a drape or horizontal blind assembly incorporating a cord lock unit as already known, it has generally been necessary to secure the cord lock unit internally within the header channel and then to pass the pull cords through that unit. This manufacturing operation is both difficult in view of the limited space within the header channel and is, therefore, both time-consuming and expensive.

In some cases it is desirable to be able to remove the cord lock unit for servicing. In most such prior art card lock designs, this is difficult and usually results in damage to the cord lock unit.

SUMMARY OF THE INVENTION

In an attempt to minimize the aforementioned problems, the present invention provides a cord lock unit through which the pull cords can be threaded with the cord lock unit separate from the header channel. Having so threaded the cords through the cord lock unit, the cord lock unit can then simply be inserted through an opening in the header channel and locked in position in that channel by a locking means provided for such purpose.

Broadly, the invention provides a cord lock unit for use with a window covering assembly which comprises a hollow channel-shaped header unit defined by a plurality of outer walls, defining an interior and an exterior, a pair of mutually spaced apart pull cords, extending upwardly into the header unit, along the interior of the head unit and downwardly from the header unit through an opening in at least one of the walls of said header unit to the exterior, and such opening being defined by a peripheral edge, and which cord lock unit comprises a first exterior portion larger than the opening in the header unit, a second interior portion secured to the first portion and dimensioned so as to be insertable through the opening in the header unit with the first extending outwardly beyond the peripheral edge of the opening, resilient engagement means adapted to be deflected during insertion of the second portion through the opening to permit such insertion and resiliently to return to a position after such insertion so as then to retain the cord lock unit in position within the opening by resilient engagement; cord being disengageable for removal of said cord lock unit; pulley means for guiding the pull cords for movement through the cord lock unit, and, releasable cord-engaging means movable between a cord-engaging position and a cord-releasing position for engaging the cords in the cord-engaging position to prevent movement thereof and for permitting movement of the cords in the cord-releasing position.

In one embodiment of this invention, the first portion of such a cord lock unit comprises a lower outer exterior portion, the second interior portion comprises a smaller upper inner portion and the resilient engagement means are provided on the upper inner portion so as to be deflected during insertion of the inner portion upwardly through the opening to permit such insertion and resiliently to return to a position after such insertion so as then to retain the cord lock unit in position within the opening by engagement of the resilient engagement means with the header unit internally thereof and outwardly of the peripheral edge of the opening.

In another embodiment of this invention, such a cord lock unit comprises an upper inner portion, a lower outer portion having resilient engagement means and adapted to be deflected during insertion downwardly through the opening to permit such insertion and resiliently to return to a position after such insertion so as then to retain the cord lock unit in position within the opening by engagement with the header unit externally thereof and outwardly of the peripheral edge of the opening.

The releasable cord-engaging means is a cord lock unit in accordance with this invention will normally be one which can be moved between its cord-engaging position and its cord-releasing position by varying the angular position of the cords relative to the header unit.

In one particular embodiment, the aforementioned releasable cord-engaging means comprises a roller having an externally ribbed cylindrical surface and a cooperating ribbed ramp whereby, when the cords are in a predetermined angular position relative to the header unit, such cords engage the roller so that, on upward movement of the cords, they cause rotation of the roller and in turn upward movement of the roller along the ramp until the cords are engaged between the roller and the pulley so then to prevent further movement of the cords whereas, when the cords are not in such predetermined angular position, upward movement of the cords does not cause upward movement of the roller along the ramp.

The resilient engagement means provided in a cord lock unit in accordance with this invention preferably comprises a pair of opposed resilient fingers.

The first and second portions of a cord lock unit in accordance with this invention are preferably integrally formed of a plastics material.

The first and second portions of a cord lock unit are, in accordance with one feature of this invention, preferably shaped so as to permit insertion of the second portion into an opening formed in two mutually perpendicular and adjacent walls of the header unit.

The invention also embraces a drape or blind assembly including a cord lock unit as already defined.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings, in which:

FIG. 1 is a somewhat schematic perspective illustration of one embodiment of a horizontal window covering assembly in accordance with this invention and incorporating a cord lock unit as also provided by this invention;

FIG. 2 is a perspective illustration on a larger scale of the cord lock unit shown in FIG. 1 and also showing separate therefrom a portion of a header channel of the blind assembly;

DESCRIPTION OF THE PREFERRED EMBODIMENT

Figure 3:
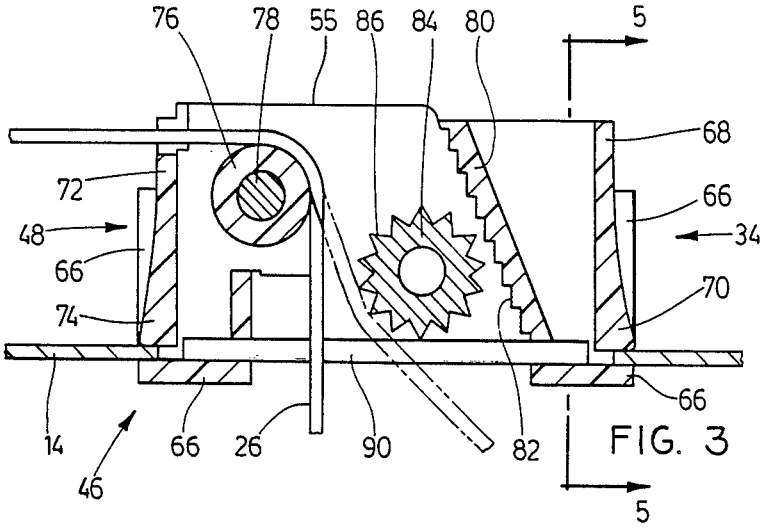
FIG. 3 is a longitudinal sectional view through the cord lock unit of FIG. 2 in position in the header channel when taken as indicated by the arrows 3—3 of that figure and showing the internal parts of that unit in a cord-releasing position.

Referring first to FIG. 1 of the accompanying drawings, it will be seen that there is indicated generally at 10 therein a window covering, in this case a horizontal blind assembly including a header unit or channel generally indicated at 12 and comprising a base wall 14 and two upstanding and mutually spaced apart side walls 16 and 18 and defining an interior and exterior.

A plurality of horizontal blind slats 20 are suspended, in a manner yet to be described, below the header channel 12, the lowermost such slat being indicated by the legend 22. Mutually spaced apart suspension pull cords 24 and 26 extend downwardly through openings 28 in the slats 20 and are secured at their lower ends to anchoring buttons 27 secured in openings in the lowermost slat 22. It will be appreciated that other window coverings such as Russian drapes, balloon drapes and the like, also make use of similar pull cords for raising and lowering the drapes and are included within the scope of the invention.

Within the header channel 12, the pull cords 24 and 26 pass over pulleys 30 and 32 respectively and extend horizontally to a cord lock unit indicated generally at 34 and to be described in greater detail as the description herein proceeds. From the cord lock unit 34, the pull cords 24 and 26 hang outwardly and downwardly and are used for raising and lowering the blind slats 20. It will be understood that the cords 24 and 26 may be integrally formed from a single length of cord so as in fact to provide what might be referred to as a control loop.

The Venetian blind assembly 10 of the embodiment as illustrated also comprises suspension and slat-rotation tapes or cords 36, 38, 40 and 42 interconnected in a known manner by rungs 43. The cords 36 and 38 pass the slats 20 at opposite edges thereof at essentially the same longitudinal position as the pull cord 24. Similarly, the cords 40 and 42 pass the slats 20 at opposite edges thereof at essentially the same longitudinal position as the pull cord 26.

In accordance with well known practice in the manufacture of Venetian blinds, the cords 36, 38 and 40, 42 are wound around a transverse tilt rod (not shown) rotatably mounted in the header channel. Rotation of the tilt rod will, in a manner well known per se, cause tilting of the slats one way or the other.

The rungs 43 support the slats 20 so that, as the cords 36 and 40 are raised and the cords 38 and 42 are lowered, the slats 20 are tilted into their closed position. Similarly, then the cords 36 and 40 are lowered and the cords 38 and 42 are raised, the slats 20 are tilted into their open positions.

In accordance with well known practice, a rotatable wand 44 is provided at one end of the header channel 12 on rotation of that wand 44, such cords 36, and 40 are caused so to be raised and cords 38 and 42 are lowered and vice versa. Any other suitable mechanism such as a pulley and chain (not shown) can be provided for causing such movement of the cords 36, 38, 40 and 42. Since the means by which opening and closing of the slats 20 is effected well known and forms no part of the present invention, such mechanism will not be described in greater detail herein.

While the preceding description has been directed to the structure and operation of a horizontal blind assembly, it should be understood that a cord lock unit, such as the cord lock unit 34, can also be used in a drape assembly in which drapes are moved between raised and lowered positions by means of pull cords such as Russians, and balloons.

The structure of the cord lock unit 34 will now be described in greater detail with reference to FIGS. 2 to 5 of the drawings. The cord lock unit 34 comprises a lower outer portion generally indicated at 46 and an upper inner portion generally indicated at 48. After the cord lock unit 34 has been installed in an opening generally indicated at 49 in the header channel 12, the outer portion 46 is disposed outwardly of the header channel 12 while the inner portion 48 is disposed actually within that channel 12.

As will best be understood by reference to FIG. 2, the opening 49 comprises aligned openings in the base 14 and the side wall 18 of the header channel 12. The length of the opening 49 is shown in FIG. 2 as having a value "L" and such opening 49 is shown as extending distances "H" and "W" from the corner 50 between the base 14 and the side wall 18 into wall 18 and base 14 respectively. The periphery of the opening 49 is indicated generally by the legend 51.

The inner portion 48 of the cord lock unit 34 comprises spaced apart longitudinal side walls 52 and 54 having inner edges 55 and which are integrally formed with angularly disposed longitudinal side walls 56 and 58 respectively of the outer portion 46. The side walls 56 and 58 are mutually perpendicular and meet at a corner 60.

When the cord lock unit 34 is disposed within the opening 49 in the header channel 12, the side wall 58 extends upwardly along the side wall 18 of the header channel 12 while the side wall 56 extends horizontally across the base 14 of the header channel 12. From FIG. 2, it will be seen that the side walls 56 and 58 extend beyond the side walls 52 and 54 respectively to provide shoulders 62 and 64 respectively. Additionally, it will be noted that the side walls 56 and 58 each have a length M and are slightly longer than the side walls 52 and 54 to provide extensions 66. It will also be understood that the length M of each of the side walls 56 and 58 is greater than the length L of the opening 49.

Figure 5:
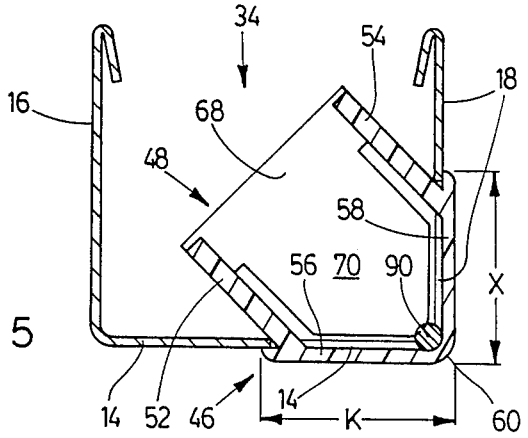
FIG. 5 is a fragmentary transverse sectional view when taken as indicated by the arrows 5—5 of FIG. 3.

As will best be understood by reference to FIG. 5, the side walls 56 and 58 of the outer portion 46 have widths K, X respectively greater than the aforementioned dimensions W, H respectively so that, when the cord lock unit 34 is disposed within the opening 49 in the header channel 12, those side walls 56, 58 extend beyond the periphery 51 of the opening 49. Similarly, the extensions 66 extend outwardly beyond the periphery 51 of the opening 49.

The side walls 52 and 54 of the inner portion 48 are connected at one end of the cord lock unit 34 by an end strap 68 which is integrally formed with a resilently flexible tongue 70. At their opposite ends, the side walls 52 and 54 are interconnected by an end strap 72 also integrally formed with a resiliently flexible tongue indicated at 74. A pulley roller 76 is rotatably mounted on a shaft 78 supported in the side walls 52 and 54 in proximity to the end strap 72. It is to be noted that the end strap 72 is disposed slightly outwardly relative to the inner edges 55 of the side walls 52 and 54 to permit the pull cords to pass freely to the pulley roller 76.

The side walls 52 and 54 are also integrally formed with a ramp member 80 which extends from a position in proximity to one end of the outer portion 46 both inwardly to the inner edges 55 of those longitudinal walls and longitudinally toward the opposite end of the cord lock unit 34. The downwardly facing surface of the ramp member 80 is formed with a plurality of transverse ribs 82.

Also disposed within the cord lock unit 34, there is provided a generally cylindrical floating roller 84 formed on its peripheral surface with a plurality of ribs 86 extending in a direction parallel to the axis of that roller. Elongated openings 88 are provided in the side walls 56 and 58 and a retaining pin 90 extends between the two ends of the cord lock unit 34 generally in alignment with the corner 60. The floating roller 84 has such a length that it is free to move in any radial direction between the side walls 52 and 54 and is prevented from passing through the openings 88 by the retaining pin 90.

In accordance with a particularly preferred feature of this invention, metallic plates 92, shown fragmentarily in FIG. 2 and only in that figure are provided on the internal surfaces of the side walls 52 and 54 to reduce friction and so to permit the floating roller 84 to move more freely within the cord lock unit 34. Such metal plates 92 also serve to reduce frictional wear of the side walls 52 and 54 as could be caused by movement of the cords 24 and 26 across those side walls.

Having described the construction of the cord lock unit 34, the manner in which it functions will now be briefly reviewed. If the free hanging ends of the pull cords 24 and 26 are pulled to raise the blind slats 20 with those cords angularly disposed as shown in phantom outline in FIG. 3 and then tension on the cords is released slightly to allow the slats to fall a short distance under the effect of gravity, engagement of the cords 24 and 26 with the floating roller 84 will cause that roller to engage the ramp 80 and the resulting rotation of the roller will in turn cause it to move upwardly along that ramp by virtue of the engagement of the ribs 86 on the roller 84 with the ribs 82 on the ramp 80. Such upward movement will continue until the floating roller 84 is in the position shown in FIG. 4 in which it serves to clamp the cords 24 and 26 between the pulley roller 76 and the floating roller 84. This then prevents any further upward movement of the cords 24 and 26 and consequently any further lowering of the blind slats 20.

Figure 4:
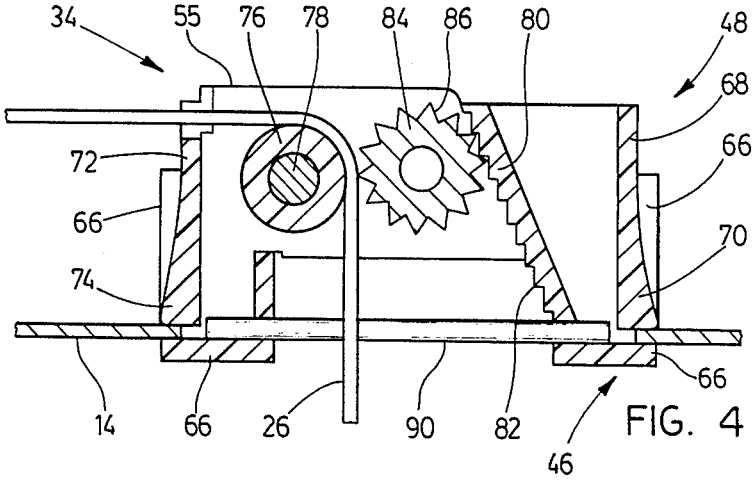
FIG. 4 is a longitudinal sectional view similar to that of FIG. 3 but showing the internal parts in a cord-engaging position.

When it is desired to lower the blind slats 20, the cords 24 and 26 are positioned in the angular position shown in solid lines in FIG. 3 and in FIG. 4 and pulled a slight distance downwardly. Such downward movement of the cords releases the floating roller 84 from its engagement with the ramp 80 and allows that roller 84 to fall into the position shown in FIG. 3. This in turn allows the blind slats 20 to be lowered.

In assembling the blind assembly 10, the pull cords 24 and 26 passing outwardly through the opening 49 in the header channel are passed through the cord lock unit 34 so as to be disposed between the pulley roller 76 and the floating roller 84. It has been found to be advantageous to have the cords 24 and 26 extend through the cord lock unit 34 on opposite sides of the retaining pin 90.

With the pull cords 24 and 26 so threaded through the cord lock unit 34, the inner portion 48 of that unit is then inserted into the opening 49 in the header channel 12. During such insertion, the flexible tongues 70 and 74 engage the peripheral end edges of the opening 49 and are flexed toward each other to allow continued insertion of the unit. When the unit 34 has been inserted to its final position as shown in FIGS. 3, 4 and 5, the tongues are disposed inwardly of the peripheral edges of the opening 49 and resiliently flex outwardly to the positions shown in FIGS. 3 and 4 so as then to engage the inner surfaces of the side wall 18 and the base 14 of the header channel 12 thereby retaining the cord lock unit 34 in position within the opening 49.

Figure 6:
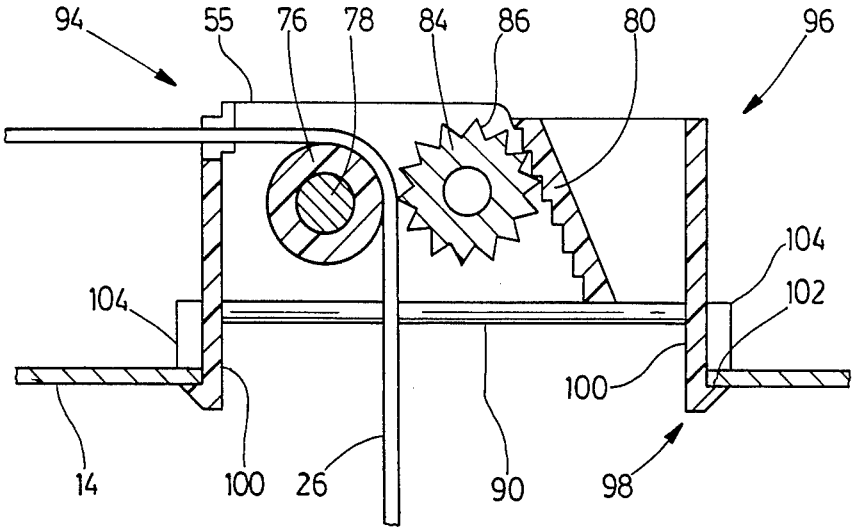
FIG. 6 is a longitudinal sectional view similar to that of FIG. 4 but showing an alternative embodiment of the invention.

The alternative embodiment of a cord lock unit in accordance with this invention as generally indicated at 94 in FIG. 6 of the drawings is similar to the unit 34 already described and, to avoid undue duplication of the description herein, identical components of the two units will be identified by the same legends.

The cord lock unit 94 differs from the unit 34 in that it is designed to be inserted downwardly into an opening, corresponding to the opening 49, comprising aligned openings in the base 14 and the side wall 18 of the header channel 12.

The cord lock unit 94 comprises a body defining side walls **94*a* and end walls 94*b*, and having a first or upper inner portion generally indicated at 96 and a second or lower outer portion generally indicated at 98. After the cord lock unit 94 has been inserted in the opening in the header channel 12, the outer portion 98 is disposed outwardly of the header channel while the inner portion 96 is disposed actually within that channel 12**.

The unit 94 comprises two resiliently flexible tongues 100 generally centrally located at opposite ends thereof and which are integrally formed with the inner portion 96 and on their outer surfaces with shoulders 102. The inner portion 96 is also provided with abutment members 104. During downward insertion, the tongues 100 flex toward each other and, after such insertion, resiliently return to the positions shown in FIG. 6 so that the shoulders 102 then engage the respective outer surfaces of the header channel 12 with the abutment members 104 abutting the respective inner surfaces of the header channel.

It will be understood that, in this particular embodiment of a cord lock unit in accordance with this invention, the flexible tongues constitute the resilient engagement means while the outer ends of those tongues constitute the outer portion 98.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A cord lock unit for use in a window covering assembly comprising a hollow channel-shaped header unit defined by a plurality of outer walls, defining an interior and an exterior, a pair of mutually spaced apart pull cords extending upwardly into said header unit along said interior of said header unit and downwardly from said header unit through an opening in at least one of said walls of said header unit to said exterior, and said opening being defined by a peripheral edge; and which cord lock unit comprises:

a first exterior portion larger than said opening in said header unit, adapted to be located on said exterior of said header unit;

a second interior portion secured to said first portion and dimensioned so as to be insertable through said opening in said header unit from said exterior into said interior with said first portion extending outwardly beyond said peripheral edge of said opening on said exterior;

resilient engagement means integral with said cord lock unit adapted to be deflected during insertion of said second portion and to pass through said opening from said exterior to said interior to permit such insertion and resiliently to return to a position after such insertion whereby to engage said interior of said header unit and to retain said cord lock unit in position within said opening by resilient engagement and being resiliently disengageable for release of said cord lock unit;

pulley means for guiding said pull cords for movement through said cord lock unit, and, releasable cord-engaging means movable between a cord-engaging position and a cord-releasing position for engaging the cords in said cord-engaging position to prevent movement thereof and for permitting movement of said cords in said cord-releasing position.

2. A cord lock unit as claimed in claim 1 and in which said first portion comprises a lower outer portion, said second portion comprises a smaller upper inner portion and said resilient engagement means are provided on said upper inner portion so as to be deflected during insertion of said inner portion upwardly through said opening to permit such insertion and resiliently to return to a position after such insertion so as then to retain said cord lock unit in position within said opening by engagement of said resilient engagement means with said header unit internally thereof and outwardly of said peripheral edge of said opening.

3. A cord lock unit as claimed in claim 1 and in which said releasable cord-engaging means can be moved between said cord-engaging position and said cord-releasing position by varying the angular position of said cords relative to said header unit.

4. A cord lock unit as claimed in claim 3 and in which said releasable cord-engaging means comprises a roller having an externally ribbed cylindrical surface and a cooperating ribbed ramp whereby, when said cords are in a predetermined angular position relative to said header unit, said cords engage said roller so that on upward movement of said cords, said cords cause rotation of said roller and in turn upward movement of said roller along said ramp until said cords are engaged between said roller and said pulley so then to prevent further movement of said cords whereas, when said cords are not in said predetermined angular position, upward movement of said cords does not cause upward movement of said roller along said ramp.

5. A cord lock unit as claimed in claim 1 and in which said resilient engagement means comprises a pair of opposed resilient fingers.

6. A cord lock unit as claimed in claim 1 and in which said first and second portions are integrally formed of a plastics material.

7. A cord lock unit as claimed in claim 6 and in which said first and second portions are shaped so as to permit insertion of said second portion into a said opening formed in two mutually perpendicular and adjacent said walls of said header unit.

8. A cord lock unit as claimed in claim 1 and which comprises a cord-separating rod for disposition of said cords on opposite sides thereof.

9. A horizontal window covering assembly comprising a hollow channel-shaped header unit defined by a plurality of outer walls, a pair of mutually spaced apart pull cords extending upwardly into said header unit, along the interior of said header unit and downwardly from said header unit through a cord lock unit disposed in an opening in at least one of said walls of said header unit, and said opening being defined by a peripheral edge, and which cord lock unit comprises:

a first exterior portion larger than said opening in said header unit;

a second interior portion secured to said first portion and dimensioned so as to be insertable through said opening in said interior of said header unit with said first portion extending outwardly on said exterior beyond said peripheral edge of said opening;

resilient engagement means integral with said cord lock unit adapted to be deflected during insertion of said second portion through said opening to permit such insertion and to pass therethrough from the exterior to the interior and resiliently to return to a position after such insertion whereby to engage said interior and to retain said cord lock unit in position within said opening and being resiliently disengageable for release of said cord lock unit.

pulley means for guiding said pull cords for movement through said cord lock unit, and, releasable cord-engaging means movable between a cord-engaging position and a cord-releasing position for engaging said cords in said cord-engaging position to prevent movement thereof and for permitting movement of said cords in said cord-releasing position.

10. A horizontal window covering assembly as claimed in claim 9 in which, said first portion comprises a lower outer portion, said second portion comprises a smaller upper inner portion and said resilient engagement means are provided on said upper inner portion so as to be deflected during insertion of said inner portion upwardly through the opening to permit such insertion and resiliently to return to a position after such insertion so as then to retain said cord lock unit in position within said opening by engagement of said resilient engagement means with the header unit internally thereof and outwardly of the peripheral edge of the opening.

11. A horizontal window covering assembly as claimed in claim 9 in which said releasable cord-engaging means can be moved between said cord-engaging position and said cord-releasing position by varying the angular position of said cords relative to said header unit.

12. A horizontal window covering assembly as claimed in claim 11 in which said releasable cord-engaging means comprising a roller have an externally ribbed cylindrical surface and a cooperating ribbed ramp whereby, when said cords are in a predetermined angular position relative to said header unit, said cords engage said roller so that on upward movement of said cords, said cords cause rotation of said roller and in turn upward movement of said roller along said ramp until said cords are engaged between said roller and said pulley so then to prevent further movement of said cords whereas, when said cords are not in said predetermined angular position, upward movement of said cords does not cause upward movement of said roller along said ramp.

13. A horizontal window covering assembly as claimed in claim 9 in which said resilient engagement means comprises a pair of opposed resilient fingers.

14. A horizontal window covering assembly as claimed in claim 9 in which said first and second portions of said cord lock unit are integrally formed of a plastics material.

15. A horizontal window covering assembly as claimed in claim 9 in which said first and second portions of said cord lock unit are shaped so as to permit insertion of said second portion thereof into a said opening formed in two mutually perpendicular and adjacent said walls of said header unit.

16. A horizontal window covering assembly as claimed in claim 9 in which said cord lock unit comprises a cord-separating rod for disposition of said cords on opposite sides thereof.

17. A cord lock unit for use in a window covering assembly comprising a hollow channel-shaped header unit defined by a plurality of outer walls, defining an interior and an exterior, a pair of mutually spaced apart pull cords extending upwardly into said header unit along said interior of said header unit and downwardly from said header unit through an opening in at least one of said walls of said header unit to said exterior, and said opening being defined by a peripheral edge; and which cord lock unit comprises:

a first lower exterior portion larger than said opening in said header unit, adapted to be located on said exterior of said header unit;

a second upper interior portion secured to said first portion and being smaller than said first portion and dimensioned so as to be insertable through said opening in said header unit into said interior with said first portion extending outwardly beyond said peripheral edge of the opening on said exterior;

resilient engagement means provided integrally on said upper interior portion so as to be deflected during insertion of said upper interior portion through said opening to permit such insertion and resiliently to return to a position after such insertion whereby to engage said interior of said header unit and to retain said cord lock unit in position within said opening by resilient engagement and being disengageable for release of said cord lock unit;

pulley means for guiding said pull cords for movement through said cord lock unit, and, releasable cord-engaging means movable between a cord-engaging position and a cord-releasing position for engaging the cords in said cord-engaging position to prevent movement thereof and for permitting movement of said cords in said cord-releasing position.

18. A cord lock unit for use in a window covering assembly comprising a hollow channel-shaped header unit defined by a plurality of outer walls, defining an interior and an exterior, a pair of mutually spaced apart pull cords extending upwardly into said header unit along said interior of said header unit and downwardly from said header unit through an opening in at least one of said walls of said header unit to said exterior, and said opening being defined by peripheral side and end edges and which cord lock unit comprises:

an upper interior body portion, in turn, having side walls and end walls, defining in section a generally rectangular shape;

abutment means formed on said end walls, being spaced apart a distance greater than the spacing between said end edges of said opening, and positioned to engage said interior of said header unit;

resilient flexible tongues formed integrally with respective said end walls of said body portion, and adapted to extend through said opening adjacent each of said end edges;

shoulders on respective said tongues, adapted to engage the exterior of said walls of said header unit, outwardly of said opening, adjacent each said peripheral end edge thereof, said tongues being resiliently flexible, whereby upon insertion of said body portion into said header unit, and upon introduction of said flexible tongues into said opening from the interior, said flexible tongues will flex towards one another, allowing the said shoulders to pass through said opening to the exterior of said header unit, and then, resiliently to engage said exterior of said header unit, and being resiliently disengageable for release of said cord lock unit from said header unit;

pulley means for guiding said pull cords for movement through said cord lock unit, and, releasable cord-engaging means movable between a cord-engaging position and a cord-releasing position for engaging the cords in said cord-engaging position to prevent movement thereof and for permitting movement of said cords in said cord-releasing position.

* * * * *